US005378966A

United States Patent [19]

Marszalik

[11] Patent Number: 5,378,966

[45] Date of Patent: Jan. 3, 1995

[54] FLUX CAPTIVATED EMISSION CONTROLLED FLYBACK TRANSFORMER

[75] Inventor: Richard J. Marszalik, Shirley, N.Y.

[73] Assignee: NCR Corporation, Dayton, Ohio

[21] Appl. No.: 991,870

[22] Filed: Dec. 16, 1992

[51] Int. Cl.[6] ..... H01J 29/70

[52] U.S. Cl. ..... 315/411; 336/178; 335/212; 335/213

[58] Field of Search ..... 315/411; 335/212, 213; 336/178, 212

[56] References Cited

U.S. PATENT DOCUMENTS 3,708,744 1/1973 Stephens et al. .
4,138,636 2/1979 Liberman .
4,409,523 10/1983 Yasumura .
4,737,755 4/1988 Hopmans .
4,887,061 12/1989 Matsumura .
5,065,186 11/1991 Valenti .
5,107,390 4/1992 Goldner .
5,111,174 5/1992 Kriz .
5,122,947 6/1992 Hishiki .
5,155,676 10/1992 Spreen .
5,161,096 11/1992 Newman .
5,210,514 5/1993 Ito et al. ..... 336/178

*Primary Examiner*—Theodore M. Blum
*Attorney, Agent, or Firm*—Elmer Wargo

[57] ABSTRACT

A flyback transformer for use with a horizontal sweep circuit and a CRT. The transformer includes a first "U-shaped" magnetic core member having first and second legs and a second "U-shaped" magnetic core member having first and second legs. The first legs of the first and second core members are spaced apart to form a gap therebetween, and the second legs of the first and second core members have planar faces that are in parallel abutting relationship with each other when the transformer is in an assembled relationship. Coil windings surround the gap and a portion of each of the first legs when the transformer is assembled.

3 Claims, 4 Drawing Sheets

FLUX CAPTIVATED EMISSION CONTROLLED FLYBACK TRANSFORMER

BACKGROUND OF THE INVENTION

1. Field of Invention

This invention relates to a flux-captivated flyback transformer which may be used in horizontal sweep circuits for CRTs used in video terminals, for example, and it also relates to a method of reducing very low frequency transmissions in a flyback transformer.

2. Background Information

Most all electronic circuits produce some electromagnetic emissions (EMI) at some levels. Personal computers, used in today's workplace, have cathode ray tubes (CRTs) that are used as video display terminals (VDTs) to enable operators to communicate with the computers. These VDTs are accused of causing psychological and physiological problems when operators use the VDTs for extended periods of time. As a precautionary measure, certain countries have developed stringent guidelines regulating electromagnetic emissions from the VDTs.

A major source of electromagnetic field emissions relates to horizontal scan circuitry which controls the position of an electron beam in the CRT. A flyback transformer that is used in the horizontal scan circuitry is the principal cause of the EMI. The flyback transformer produces the high voltage which drives the electron beam mentioned.

There have been various efforts to design the flyback transformers so that the emissions that they generate are minimized. Some of these efforts include various types of shields and additional windings to offset some of the emissions mentioned.

SUMMARY OF THE INVENTION

An object of this invention is to provide a low cost flyback transformer which is simple in design and effective in reducing emissions of the type mentioned.

Another object of this invention is to provide a method of reducing very low frequency (VLF) transmissions in a flyback transformer.

Another object of this invention is to provide a flyback transformer that can be placed in a horizontal sweep circuit without shielding and without consideration of the orientation of the flyback transformer relative to the horizontal sweep circuit.

In a first aspect of this invention, there is provided an electromagnetic device comprising:

- a first core member having first and second legs, with said second leg having an associated planar face thereon;
- a second core member having first and second legs, with said second leg having an associated planar face thereon;
- said first legs of said first and second core members being aligned and spaced from each other to form a gap therebetween when said first and second core members are in an assembled relationship;
- said second legs of said first and second core members having the associated said planar faces in parallel abutting relationship with each other when said first and second core members are in said assembled relationship; and
- coil windings surrounding said gap and only a portion of each of said first legs of said first and second core members when in said assembled relationship.

In a second aspect of this invention, there is provided a method of reducing very low frequency (VLF) transmissions in a flyback transformer comprising the steps of:

(a) constructing a first "U-shaped" core member having first and second legs and a second "U-shaped" core member having first and second legs, with said first and second "U-shaped" core members being shaped to facilitate an assembly of said flyback transformer;

(b) dimensioning said first legs of said first and second "U-shaped" core members to have a gap therebetween when said flyback transformer is in an assembled relationship;

(c) forming said second leg of said first "U-shaped" core member to have an associated planar face and forming said second leg of said second "U-shaped" core member to have an associated planar face in parallel abutting relationship with the associated planar face of said second leg of said first "U-shaped" core member when said flyback transformer is in said assembled relationship; and (d) placing coil windings around at least a portion of each of said first legs of said first and second "U-shaped" core members and said gap prior to said flyback transformer being assembled in said assembled relationship.

The above advantages, and others, will be more readily understood in connection with the following specification, claims, and drawing.

DETAILED DESCRIPTION OF THE PREFERRED EMBODIMENT

Figure 1:
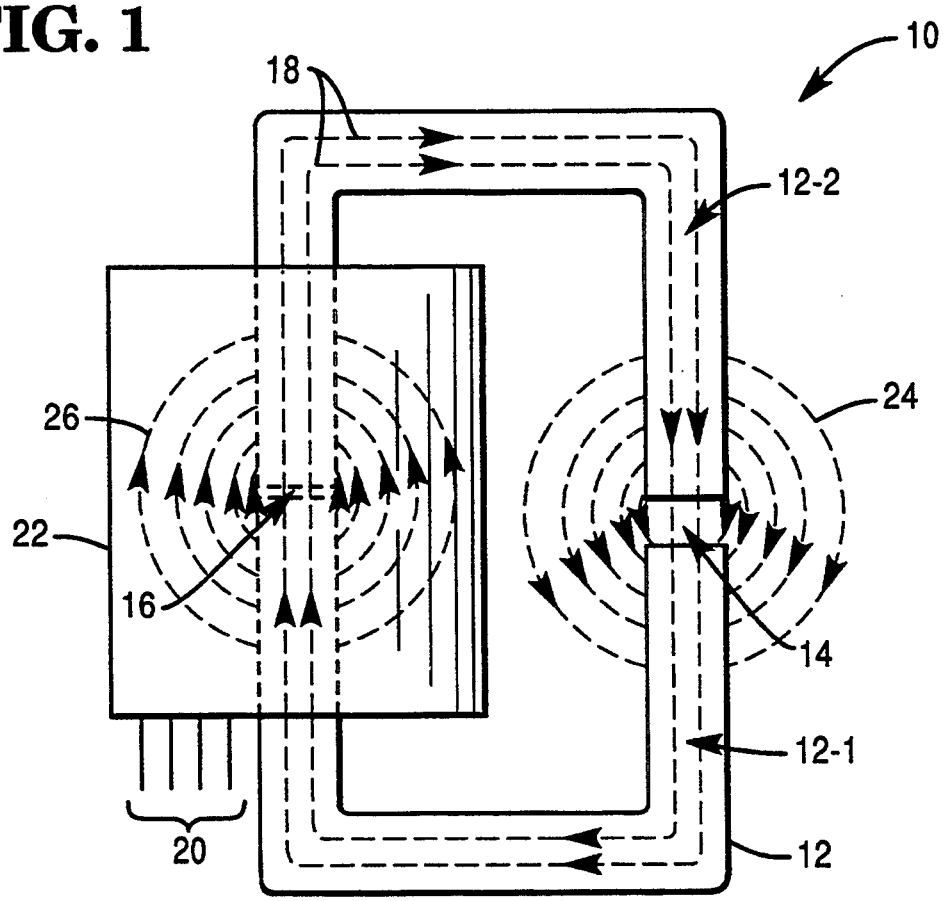
PRIOR ART FIG. 1
FIG. 1 is a side view of a Prior Art flyback transformer.

FIG. 1 is a side view of a flyback transformer 10 which is part of the prior art. The transformer 10 includes a magnetic core 12 made up of a first "U-shaped", magnetic core member 12-1 and a second "U-shaped, magnetic core member 12-2 which are dimensioned and positioned as shown in FIG. 1 to provide an outside air gap 14 and an internal air gap 16 with flux lines 18 being shown in the magnetic core 12. Coil windings surround the magnetic core 12 at the area of the internal air gap 16, and only the leads 20 for the coil windings are shown in FIG. 1. The coil windings are enclosed in an enclosure 22.

One of the problems with the transformer 10 shown in FIG. 1 is that it generates fringing shown by lines 24 and 26. The fringing lines 26 are contained by the enclosure 22; however, the fringing lines 24 at the outside gap 14 produce the undesirable very low frequency (VLF) emissions mentioned earlier herein. The gaps 14 and 16 control the inductance which produces the necessary flyback voltage which generates the extra high voltage that is necessary for the proper functioning of the associated CRT.

Figure 2:
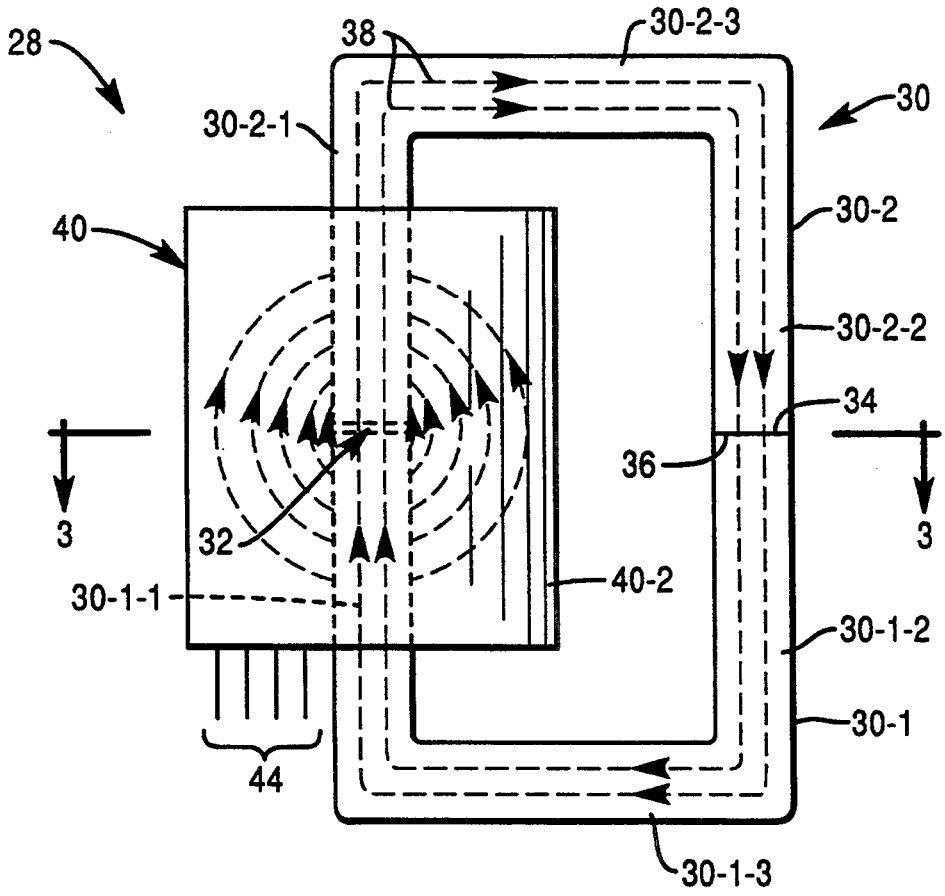
FIG. 2 is a side view of a preferred embodiment of a flyback transformer made according to this invention.

FIG. 2 shows a flyback transformer 28 made in accordance with a preferred embodiment of this invention. The transformer 28 includes a magnetic core 30 that is made of the usual ferrite materials and that is comprised of a first "U-shaped" core member 30-1 (hereinafter referred to as core member 30-1) and a second "U-shaped" core member 30-2 (hereinafter referred to as core member 30-2). The first and second core members 30-1 and 30-2 are positioned in an assembled relationship shown in FIG. 2.

The first core member 30-1 (FIG. 2) has first and second legs 30-1-1 and 30-1-2, respectively, which are joined by a section 30-1-3. Similarly, the second core member 30-2 has first and second legs 30-2-1 and 30-2-2, respectively, which are joined by a section 30-2-3. The first legs 30-1-1 and 30-2-1 of the core members 30-1 and 30-2 are aligned and spaced from each other to form an internal gap 32. The second legs 30-1-2 and 30-2-2 of the first and second core members 30-1 and 30-2 are also aligned with each other as shown in FIG. 2. Each of the core members 30-1 and 30-2 has a planar surface at the free end of the associated legs, as shown by the planar surface 34 (FIG. 3) for the free end of second leg 30-1-2 of the first core member 30-1. The planar surface 34 is perpendicular to the associated leg, like 30-1-2, for example.

One of the design aspects of the transformer 28 included eliminating the outer gap 14 included in the prior art transformer 10 shown in FIG. 1 and essentially doubling the dimension of the internal air gap 32 shown in the transformer 28 shown in FIG. 2. This was found to provide the inductance characteristics mentioned with regard to the prior art transformer 10 shown in FIG. 1. A feature of this invention is by eliminating the outside air gap (like 14 in FIG. 1), the VLF emissions were considerably reduced as will be explained hereinafter.

Another feature of the present invention is that "off-the-shelf" or standard "U-shaped" core members may be used to construct the transformer 28. These core members are like core members 30-1 and 30-2. With the design mentioned for transformer 28, the internal gap 32 may be provided by simply machining off a portion of the first leg 30-2-1 of the second core member 30-2. This action reduces the cost of manufacturing the transformer 28. In the embodiment described, the planar face 34 and the planar face 36 on the second leg 30-2-2 are in parallel abutting contact when the transformer 28 is assembled. As an illustration, if the outside air gap 14 in the prior art transformer 10 were one millimeter and the inside air gap were also one millimeter, the transformer 28 made according to this invention, would have no gap between the planar faces 34 and 36, and there would be a gap of two millimeters at the internal gap 32. Flux lines 38 are shown in the magnetic core 30.

The transformer 28 also includes a means 40 for supporting coil windings which may be conventional and are included in the transformer 28. The supporting means 40 includes first and second cylindrical tubes 40-1 and 40-2 shown in FIG. 3. The primary coil windings are mounted or wound on the first cylindrical tube 40-1, and they are shown only schematically as a segment 42 of wire, and the coil windings have a longitudinal axis which is parallel to the first legs 30-1-1 and 30-2-1. The secondary coil windings are mounted or wound on the second cylindrical tube 40-2, and they are shown only schematically as a segment 43 of wire The endings of the coil windings (like segments 42 and 43) are shown collectively by the bracket 44 shown in FIG. 2. A protective layer of material, like an epoxy coating (not shown), for example, may be deposited over the exterior of the support means 40.

Figure 3:
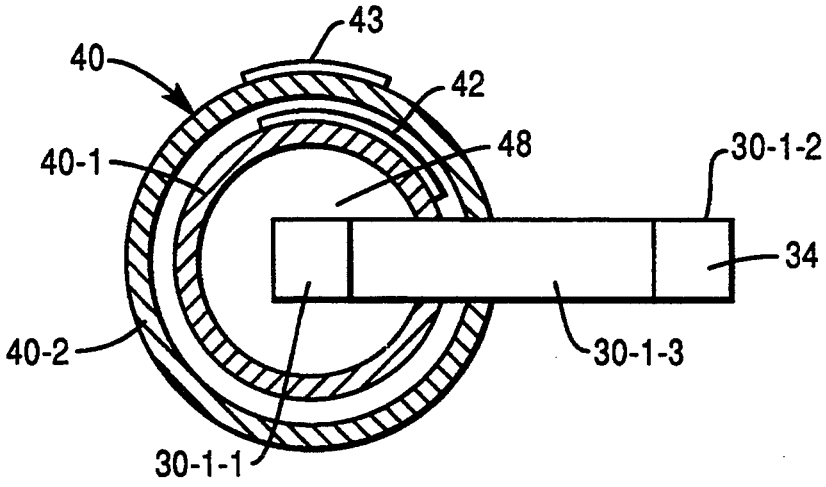
FIG. 3 is a cross-sectional view, taken along the line 3—3 of FIG. 2 to show details of coil windings in the transformer shown in FIG. 2.
Figure 7:
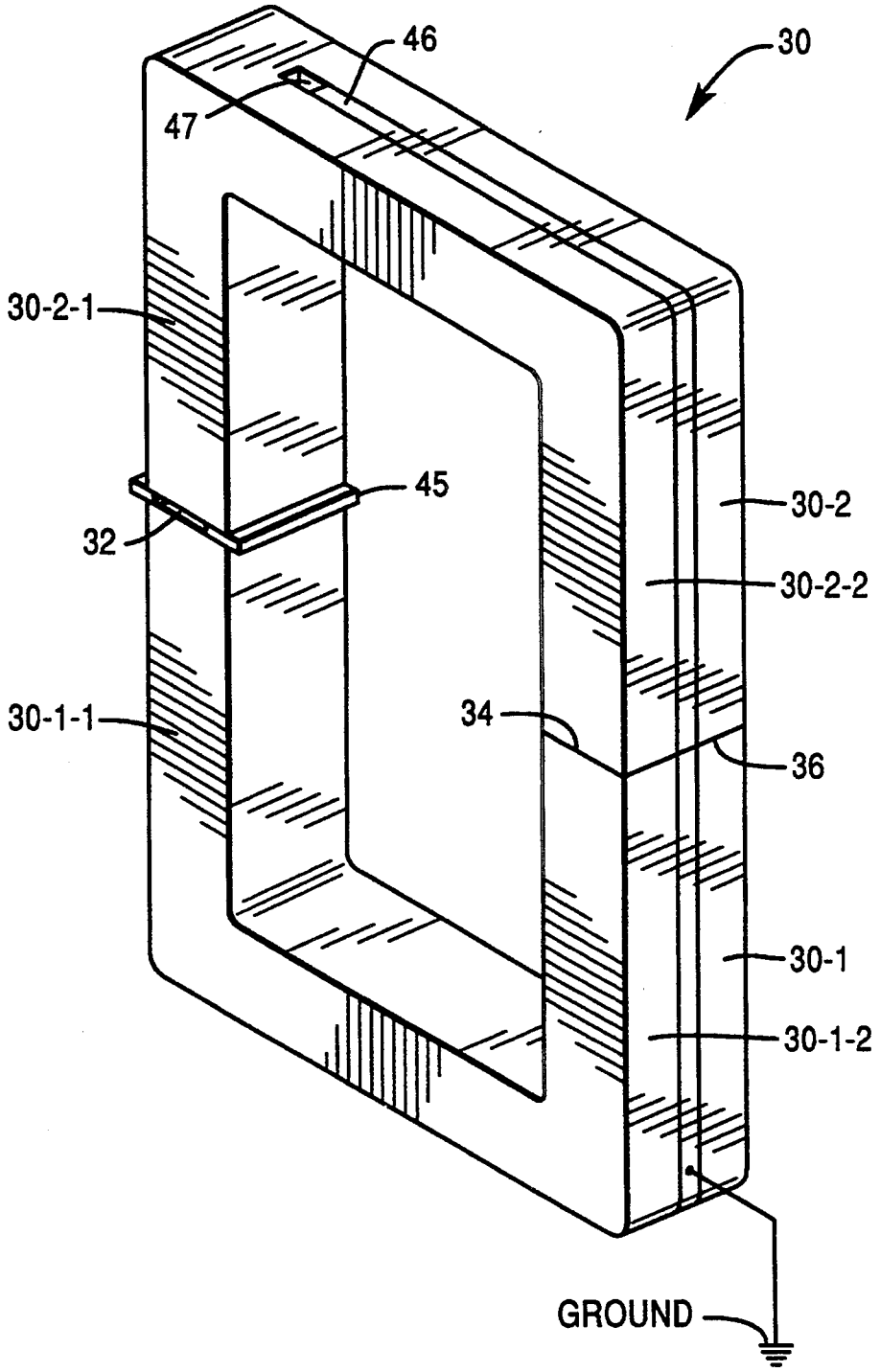
FIG. 7 is a schematic diagram showing a rectangular "C" clip which is used to hold together magnetic core elements of the transformer.

During assembly of the flyback transformer 28, a plastic spacer 45, made of polyurethane, for example, is positioned between the first and second legs 30-1-1 and 30-2-1 of the core members 30-1 and 30-2, and these legs are positioned in the supporting means 40 as shown in FIGS. 2 and 3. Thereafter, the second legs 30-1-2 and 30-2-2 are aligned and a rectangular "C-shaped" clip 46 (FIG. 7) is fitted into a mating recess 47 located around the periphery of the core 30. A conventional fixture may be used to hold the transformer 28, and when so held, a conventional or epoxy material is filled in the voids, like area 48 to hold the supporting means 40 and the magnetic core member in the positions shown so that the planar faces 34 and 36 are in abutting relationship, and the appropriate gap 32 exists between the first and second legs 30-1-1 and 30-2-1 as previously mentioned. In operation, the magnetic core 30 is grounded (via the clip 46), as shown in FIG. 7, to also reduce the VLF emissions. In the embodiment described, the gap 32 is 0.254 mm, and it develops the primary inductance of the flyback transformer 28 needed to develop the associated high voltage. In the embodiment described, the inductance needed was 1.32 millihenrys. The dimensions of first leg 30-1-1 (prior to machining), the section 30-1-3, and the second leg 30-1-2 (FIG. 2) are 29 millimeter, 35 millimeters, and 29 millimeters, respectively. Naturally, these dimensions would change for different transformers.

Figure 4:
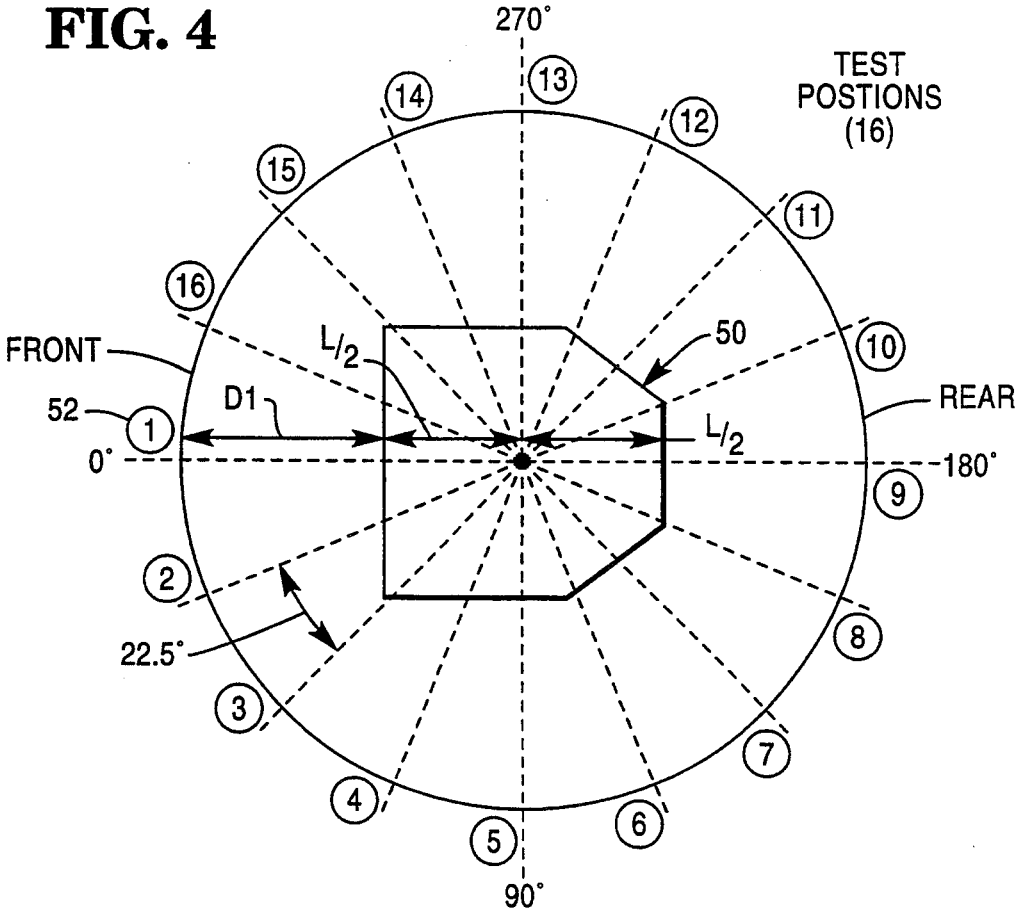
FIG. 4 is a plan view of a test set up used in making tests for VLF emissions.
Figure 5:
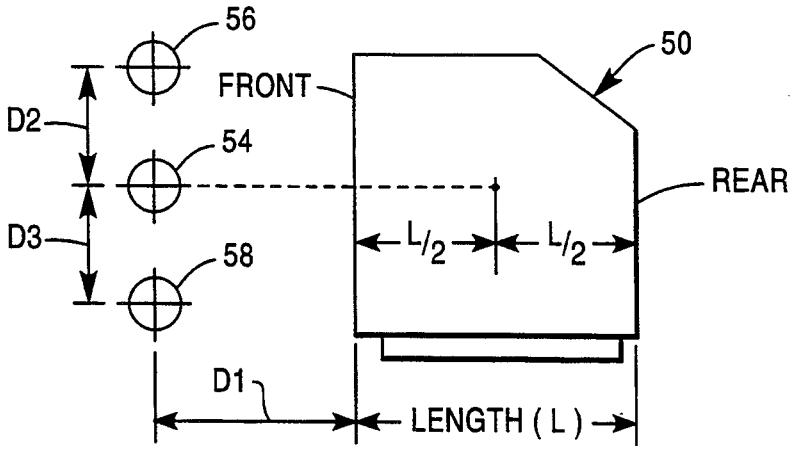
FIG. 5 is a side view, in elevation, of the test set up shown in FIG. 4.

FIG. 4 shows a top view of a test set up which is used to test the prior art flyback transformer 10 shown in FIG. 1 and the flyback transformer 28 made according to this invention relative to very low frequency (VLF) transmissions. FIG. 5 shows the side view of the test set up shown in FIG. 4. The dimensions given in FIGS. 4 and 5 are in meters D1 in FIG. 4 is i0.5 meter and D2 and D3 in FIG. 5 are equal to 0.3 meter. The VLF measurements made for the prior art flyback transformer 10 are recorded in TABLE #1, and the VLF measurements made for the flyback transformer 28, made according to this invention, are shown in TABLE #2. TABLES #1 and #2 are shown hereinafter. The measurements were made on an ADDS model 2201 video display terminal 50 shown in FIGS. 4 and 5, with the model 2201 terminal being presently obtainable from Applied Digital Data Systems of Hauppauge, N.Y. The "nT" appearing in TABLES #1 and #2 stand for nano Teslas.

TABLE #1

| TEST LOCATION Position | VLF MEASUREMENTS TEST DATA 0.3 m Up (D2) nT | 0.5 m Center (D1) nT | 0.3 m Down (D3) nT |
|---|---|---|---|
| 1 (0°) | 14 | 12 | 9 |
| 2 | 14 | 13 | 10 |
| 3 | 14 | 13 | 9 |
| 4 | 13 | 12 | 8 |
| 5 (90°) | 13 | 12 | 9 |
| 6 | 12 | 12 | 9 |
| 7 | 13 | 13 | 12 |
| 8 | 14 | 14 | 12 |
| 9 (180°) | 13 | 18 | 15 |
| 10 | 13 | 22 | 18 |
| 11 | 17 | 25 | 21 |
| 12 | 17 | 19 | 21 |
| 13 (270°) | 16 | 15 | 19 |
| 14 | 15 | 17 | 15 |
| 15 | 15 | 14 | 13 |
| 16 | 14 | 14 | 11 |

TABLE #2

| TEST LOCATION Position | VLF MEASUREMENTS TEST DATA 0.3 m Up (D2) nT | 0.5 m Center (D1) nT | 0.3 m Down (D3) nT |
|---|---|---|---|
| 1 (0°) | 5 | 4 | 5 |
| 2 | 6 | 5 | 5 |
| 3 | 7 | 5 | 5 |
| 4 | 5 | 5 | 5 |
| 5 (90°) | 5 | 5 | 4 |
| 6 | 3 | 5 | 4 |
| 7 | 3 | 4 | 2 |
| 8 | 3 | 4 | 2 |
| 9 (180°) | 3 | 4 | 3 |
| 10 | 3 | 5 | 3 |
| 11 | 3 | 5 | 4 |
| 12 | 5 | 5 | 5 |
| 13 (270°) | 6 | 7 | 5 |
| 14 | 7 | 8 | 5 |
| 15 | 6 | 8 | 4 |
| 16 | 4 | 7 | 5 |

Continuing with the testing, there are 16 test positions or locations that are distributed around the terminal 50, as shown in FIG. 4. Zero degrees represents the front of the terminal 50, and 180 degrees represents the rear thereof. Numbers that are included in circles are used to indicate testing positions. For example, a circle with "1" in it that is referenced by number 52 and that is close to zero degrees in FIG. 4 is referenced as "1(0°) in the first Test Location Position shown in TABLE #1, for example. There are three positions for each one of the 16 positions shown in FIG. 4. As seen in FIG. 5, there is one position, shown by circle 54, that is at the center of the terminal 50 and is positioned at a distance of 0.5 meter from the face of the terminal 50; this position is referred to as "0.5 m center" on TABLE #1, for example. A next position, shown by circle 56, that is positioned at a distance of 0.3 meter above the circle 54 is referred to as "0.3 m up" on TABLE #1. And finally, a last position, shown by circle 58, that is positioned at a distance of 0.3 meter below the circle 54, is referred to as "0.3 m down" on TABLE #1. The instrument that was used in making the tests was a Combinova magnetic field meter MFM1000. A total of 48 measurement points were made for the transformer 10, shown in FIG. 1, and the results are recorded in TABLE #1. Similarly, a total of 48 measurements points were made for the transformer 28 of this invention, and the results are recorded in TABLE #2. Charts #1 and #2 are arranged in the same format.

In testing, the magnetic probe of the field meter mentioned was placed at the positions mentioned with regard to FIGS. 4 and 5. The guidelines for testing are those generated by the Swedish VDT MPR 1990:8; Emission Properties Section 2, Paragraph 2.04. VLF testing was performed, with Band II measured from 2 KHz to 400 KHz. The emission guidelines ≦25 nT are measured 0.5 meter around the terminal 50 as previously explained in relation to FIGS. 4 and 5.

The following TABLE #3 exhibits the averages of the 16 test points in each of the test planes mentioned with regard to circles 54, 56, and 58 mentioned in FIG. 5. The VLF measurements mentioned were made on transformer 10 (Prior Art) and the transformer 28 which is made according to this invention. It is apparent that the emissions generated by the transformer 28 are about one third of the emissions generated by the transformer 10 of the prior art. With the flyback transformer 28, most of the emissions mentioned were captivated inside the enclosure 46. The "nT" appearing in TABLE #3 stands for nano Teslas.

TABLE #3

| | TRANS-FORMER 10 | TRANS-FORMER 28 |
|---|---|---|
| VLF Emissions: @ 50 cm @ Center | 15.31 nT | 5.38 nT |
| VLF Emissions: @ 50 cm @ 30 cm above Center Plane | 14.19 nT | 4.63 nT |
| VLF Emissions: @ 50 cm @ 30 cm below Center Plane | 13.19 nT | 4.13 nT |

Figure 6:
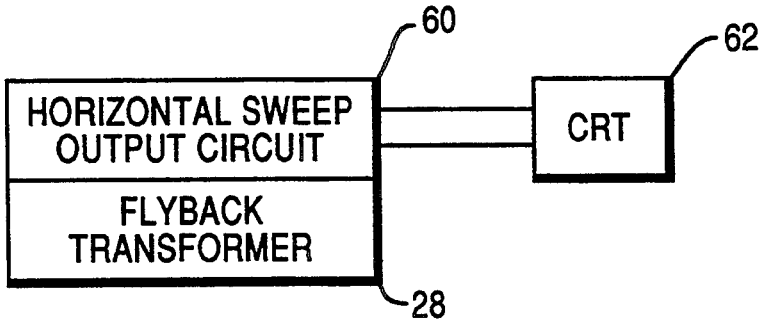
FIG. 6 is a schematic view showing the flyback transformer made according to this invention in combination with a horizontal sweep output circuit and a CRT.

Another problem with flyback transformers of the prior art is that extensive testing and calculating are necessary to determine "the best location" in which to position the flyback transformer relative to the associated horizontal sweep circuit. Another feature of the flyback transformer 28, made according to this invention, is that it can be positioned anywhere within an associated horizontal sweep output circuit 60 without regard to the orientation of the flyback transformer relative to the sweep circuit 60. This feature is shown only schematically in FIG. 6 which also includes the associated CRT 62. A conventional horizontal sweep circuit is shown in U.S. Pat. No. 5,065,186 which is assigned to the same assignee as is the present invention, and which is incorporated herein by reference.

What is claimed is:

1. A flyback transformer comprising:

a first U-shaped core member having first and second legs, with said second leg having an associated planar face thereon;

a second U-shaped core member having first and second legs, with said second leg having an associated planar face thereon;

said first legs of said first and second U-shaped core members being aligned and spaced from each other to form a gap therebetween when said first and second U-shaped core members are in an assembled relationship;

said second legs of said first and second U-shaped core members having the associated said planar faces in parallel abutting relationship with each other when said first and second U-shaped core members are in said assembled relationship; and coil windings surrounding said gap and only a portion of each of said first legs of said first and second U-shaped core members when in said assembled relationship;

said coil windings having a longitudinal axis which is aligned with said first legs of said first and second U-shaped core members;

said flyback transformer further comprising:

first and second cylindrical tubes;

said coil windings comprising a primary winding mounted on said first cylindrical tube and a secondary coil winding mounted on said second cylindrical tube, with said first cylindrical tube with said primary winding thereon mounted inside of said second cylindrical tube; and said first legs of said first and second U-shaped core members being mounted inside said first cylindrical tube when said first and second U-shaped members are in said assembled relationship;

said first and second U-shaped core members each having a recess therein to receive a C-shaped clip when in said assembled relationship; and a C-shaped clip mounted in the recesses of said first and second U-shaped members to hold said planar faces in parallel abutting relationship with each other and to provide a ground connection for said flyback transformer.

2. A method of reducing very low frequency (VLF) transmissions in a flyback transformer comprising the steps of:

(a) constructing a first U-shaped core member having first and second legs and a second U-shaped core member having first and second legs, with said first and second U-shaped core members being identical and being shaped to facilitate an assembly of said flyback transformer and having a recess therein to receive a C-shaped clip therein;

(b) dimensioning said first legs of said first and second U-shaped core members to have a gap therebetween when said flyback transformer is in an assembled relationship by altering only one of said first legs of said first and second legs of said first and second U-shaped members to make said one of said first legs shorter than the other first leg remaining to provide said gap;

(c) forming said second leg of said first U-shaped core member to have an associated planar face and forming said second leg of said second U-shaped core member to have an associated planar face in parallel abutting relationship with the associated planar face of said second leg of said first U-shaped core member when said flyback transformer is in said assembled relationship;

(d) placing coil windings around at least a portion of each of said first legs of said first and second U-shaped core members and said gap prior to said flyback transformer being assembled in said assembled relationship;

(e) placing said C-shaped clip in said recesses to hold the planar faces of said first and second U-shaped core members in abutting relationship; and (f) filing any voids between said first legs of said first and second U-shaped core members and said coil windings surrounding said gap with a material to hold said flyback transformer in said assembled relationship.

3. A combination comprising:

a CRT;

a horizontal sweep circuit for said CRT; and a flyback transformer that can be placed in said horizontal sweep circuit without shielding and without regard for the orientation of said flyback transformer relative to said horizontal sweep circuit;

said flyback transformer comprising:

a first a first U-shaped core member having first and second legs, with said second leg having an associated planar face thereon;

a second U-shaped core member having first and second legs, with said second leg having an associated planar face thereon;

said first legs of said first and second U-shaped core members being aligned and spaced from each other to form a gap therebetween when said first and second U-shaped core members are in an assembled relationship;

said second legs of said first and second U-shaped core members having the associated said planar faces in parallel abutting relationship with each other when said first and second U-shaped core members are in said assembled relationship; and coil windings surrounding said gap and only a portion of each of said first legs of said first and second U-shaped core menders when in said assembled relationship;

said coil windings having a longitudinal axis which is aligned with said first legs of said first and second U-shaped core members;

said flyback transformer further comprising:

first and second cylindrical tubes;

said coil windings comprising a primary winding mounted on said first cylindrical tube and a secondary coil winding mounted on said second cylindrical tube, with said first cylindrical tube with said primary winding thereon mounted inside of said second cylindrical tube; and said first legs of said first and second U-shaped core members being mounted inside said first cylindrical tube when said first and second U-shaped members are in said assembled relationship;

said first and second U-shaped core members each having a recess therein to receive a C-shaped clip when in said assembled relationship; and a C-shaped clip mounted in the recesses of said first and second U-shaped members to hold said planar faces in parallel abutting relationship with each other and to provide a ground connection for said flyback transformer.

* * * * *